US009120217B2

(12) United States Patent
Fischer, Jr. et al.

(10) Patent No.: US 9,120,217 B2
(45) Date of Patent: Sep. 1, 2015

(54) SNOW RAKE WITH TELESCOPING POLE

(71) Applicant: Suncast Technologies, LLC, Palm Beach Gardens, FL (US)

(72) Inventors: Gary M. Fischer, Jr., Poplar Grove, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 291 days.

(21) Appl. No.: 13/761,967

(22) Filed: Feb. 7, 2013

(65) Prior Publication Data

US 2014/0215864 A1 Aug. 7, 2014

(51) Int. Cl.
*E04D 13/10* (2006.01)
*B25G 1/04* (2006.01)

(52) U.S. Cl.
CPC ..... *B25G 1/04* (2013.01); *E04D 13/106* (2013.01); *Y10T 16/473* (2015.01)

(58) Field of Classification Search
CPC ..... E01H 5/02; E04D 13/106; E04D 13/0765; E04D 15/006; F16B 7/1454; B25G 1/04; Y10T 16/473
USPC ..... 37/265, 266, 316, 285; 294/54.5, 59, 294/176; 56/400.04, 400.15; 172/376, 377, 172/371; 403/109.1, 109.2, 109.5, 110, 403/374.5, 374.2, 374.1, 377, 373, 104
See application file for complete search history.

(56) References Cited

U.S. PATENT DOCUMENTS

| | | | | | |
|---|---|---|---|---|---|
| 3,091,790 | A | * | 6/1963 | Schroeder | 15/105 |
| 3,583,747 | A | * | 6/1971 | Lambert | 37/268 |
| 3,751,748 | A | * | 8/1973 | Roe et al. | 15/230.11 |
| 4,325,157 | A | * | 4/1982 | Balint et al. | 15/144.4 |
| 4,848,819 | A | | 7/1989 | Moorefield | |
| 4,947,562 | A | * | 8/1990 | Williamson | 37/197 |
| 5,067,197 | A | | 11/1991 | Cormier | |
| D329,004 | S | | 9/1992 | King | |
| D345,492 | S | | 3/1994 | Mele | |
| 5,524,369 | A | * | 6/1996 | Phillips | 37/285 |
| D384,558 | S | | 10/1997 | Mele | |
| 5,676,413 | A | | 10/1997 | Hauck | |
| D391,815 | S | | 3/1998 | Venezio | |
| D405,666 | S | | 2/1999 | Whitehead et al. | |
| 5,887,364 | A | | 3/1999 | Toth | |
| D414,389 | S | | 9/1999 | Mele | |
| 6,142,699 | A | * | 11/2000 | Pao | 403/109.5 |
| 6,189,942 | B1 | | 2/2001 | Peterson et al. | |
| D539,496 | S | | 3/2007 | Sickler et al. | |
| 8,347,528 | B1 | * | 1/2013 | Seltzer | 37/265 |

* cited by examiner

*Primary Examiner* — Robert Pezzuto
(74) *Attorney, Agent, or Firm* — McHale & Slavin, P.A.

(57) ABSTRACT

A telescoping pole and blade to form a snow rake. The pole has a plurality of segments selectively axially movable relative to one another. The pole segments are keyed to one another to prevent relative rotation between adjacent pole segments. A lock device is associated with adjacent pairs of pole segments to selectively fix the relative axial positions of the pairs of pole segments.

6 Claims, 7 Drawing Sheets

SNOW RAKE WITH TELESCOPING POLE

FIELD OF INVENTION

A snow rake with telescoping pole is provided. The rake includes a blade for contacting snow and moving it with a pulling force by the user. The pole has a plurality of segments selectively axially movable relative to one another forming a telescoping arrangement.

BACKGROUND OF THE INVENTION

Snow rakes for use in removing snow from a roof or the like are known in the art. They typically comprise a blade connected to a pole. There may also be braces connected to and extending between the blade and the pole to help the blade resist bending under load. The poles are typically of a multi-segment type that requires assembly by connecting the segments together to obtain a desired pole length for use of the rake. While effective, such pole segments are typically aluminum for weight and price considerations, and will have thin walls that are easily permanently deformed rendering them non-usable. Even a minor distance drop onto a hard surface can deform a pole segment. Means to secure the segments together are needed. One form is a so called snap pin. A snap pin includes a pin mounted on a flexible arm usually secured in the interior of a first pole segment with the pin extending through a hole in the first pole segment. The pin arrangement acts as a detent. A second pole segment has a portion that slides over the first pole segment and a hole in it is aligned with the pin which then protrudes therethrough releasably locking the segments together. While effective in locking, this can be difficult to accomplish while wearing gloves in cold weather. It is similarly difficult to decouple the pole segments. Another problem with this type of multi segment type of pole is that the length of the assembly is fixed at certain increments of length. However, such a construction positively prevents relative longitudinal and rotational movement between pole segments.

Some snow rakes have a telescoping pole assembly attached to the blade. The pole segments, though, are selectively fixed relative to one another by friction as with a split collet and threaded tapered locking ring. This is true of both axial position and rotational position. The surface area of frictional contact is fixed by the shape of the two engaging surfaces, round and smooth. To increase the frictional force, increased compression is needed which then requires either increased tube wall thickness and/or increasing surface roughness of either or both of the engaging surfaces. Typically these are not very effective devices because of the difficulty in obtaining enough friction to prevent relative movement between pole segments, either longitudinally or rotationally. Experience with a split collet type friction device indicates these are not typically effective and difficult to use, particularly when wearing gloves and when the axial force to be applied to pull a load is large.

There is thus a need for an improved snow rake with a telescoping pole.

SUMMARY

A snow rake with a blade and telescoping pole is provided. The rake is configured for pulling snow from a surface such as a roof. The rake includes a blade having a first surface portion for normally engaging material to be moved toward a user with a pulling force applied by the user. A telescoping pole is connected to the blade and has a plurality of segments including a first segment and a second segment. The first and second segments are selectively movable axially relative to one another. One of the pole segments is attached to the blade adjacent a proximal end portion of the pole and projects from the blade generally away from the first surface portion with a distal end portion of the pole being remote from the blade. At least one of the pole segments has an exterior surface portion received inside another of the pole segments. The pole segments are keyed with a rib and groove arrangement to positively resist relative rotation therebetween when secured against relative axial movement. Means is associated with the pole segments and operable to prevent axial separation of the pole segments. A lock device is mounted to a pole segment adjacent an open end thereof. It is configured to receive another pole segment therein and is operable to selectively secure adjacent pole segments against relative axial movement at any of a plurality of axial positions between the pole segments.

BRIEF DESCRIPTION OF THE DRAWINGS

Like numbers are used throughout this application represent like or similar parts and/or construction.

DETAILED DESCRIPTION OF THE INVENTION

Figure 1:
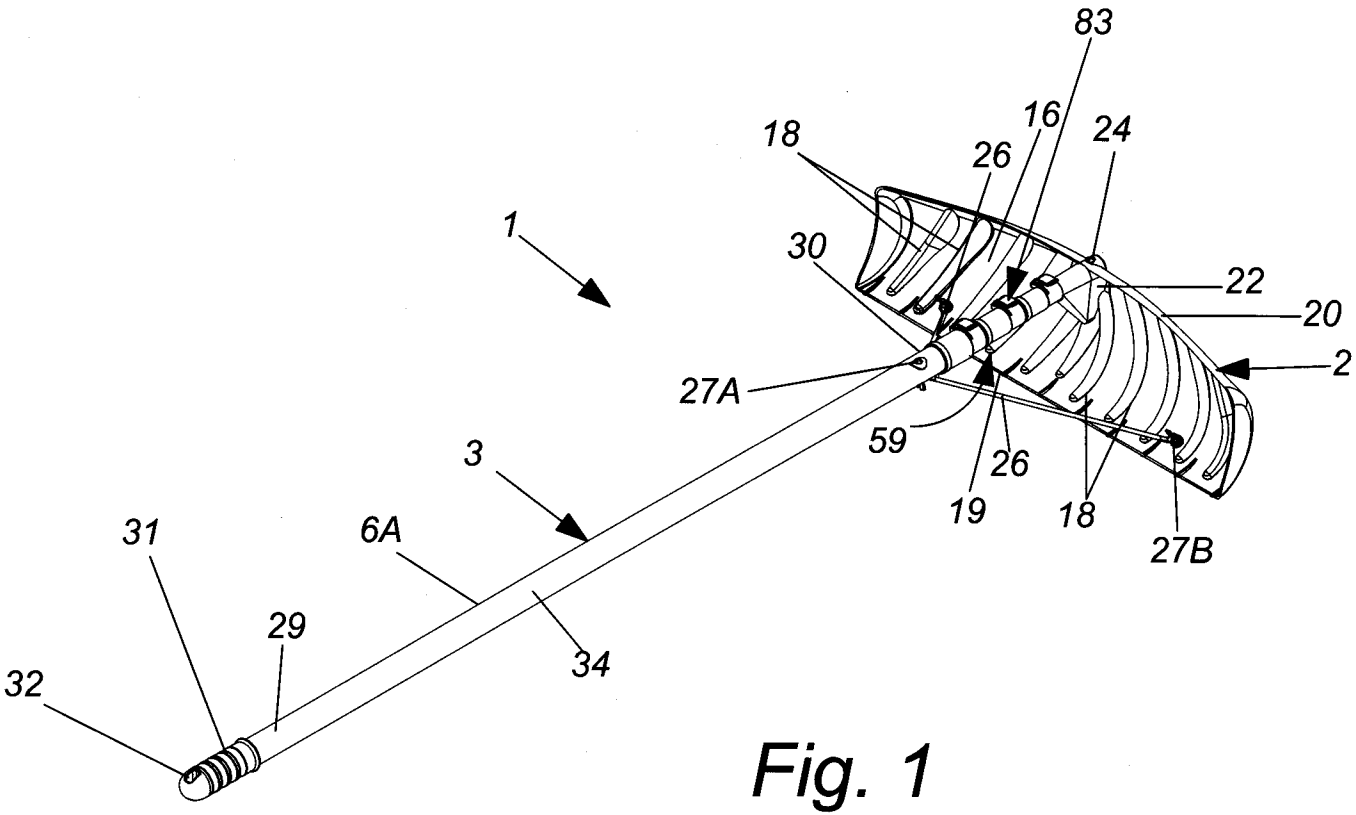
FIG. 1 is a perspective view of a snow rake.
Figure 2:
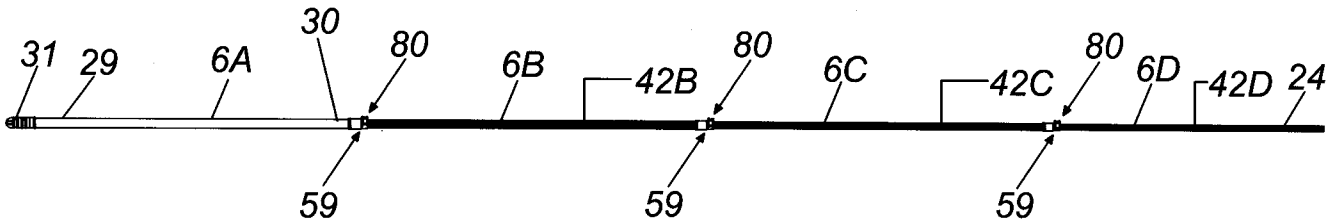
FIG. 2 is a side view of a telescoping pole of the rake shown partially extended.

Referring to FIG. 1, a snow rake, designated generally as 1, is illustrated. The rake 1 includes a blade 2 and a telescoping pole 3. It is to be understood that the pole 3 can be used with other implements such as a saw blade, squeegee and the like. The pole 3 includes a plurality of pole segments which are illustrated as four in quantity and are designated 6A, 6B, 6C and 6D with the pole segments being in telescoping relationship with the segment 6B being slidably received in segment 6A and adjacent thereto, the segment 6C being slidably received in the segment 6B and adjacent thereto and the segment 6D being slidably received in segment 6C and adjacent thereto. See FIG. 2. Any suitable number of segments 6 can be provided in a quantity of two or more as desired.

The blade 2 can be of any suitable shape and, as shown, has a concave surface 16 from which the pole 3 extends. The surface 16 is positioned for normally engaging material such as snow when the blade 2 is moved in a direction that the surface 16 is facing. As shown, the blade 2 has a compound concave curvature with one curvature being along its length and one curvature being along its height. The blade 2 can be provided with reinforcing ribs 18 that extend in a direction generally from a scraping lower edge 19 toward a top edge 20. The ribs 18 are preferably formed as integral parts of the blade 2. The blade 2 is also provided with means for attaching the pole 3 thereto. As shown, a socket member 22 projects from the surface 16 of the blade 2 and is sized and shaped to receive a proximal (relative to the blade 2) end portion 24 of the pole segment 6D therein. The blade 2 can be removably attached to the pole 6 as with a bolt and nut extending through holes in the pole segment 6D and the socket member 22 or with means such as a snap locking detent allowing push together securement. Such securement secures the blade 2 to the pole segment 6D in a manner to fix it against both axial and rotational relative movement. In a preferred embodiment, the blade 2 is of a molded construction using a graphite containing polymer. A replaceable wear strip (not shown) can be provided at the lower edge 19 if desired.

The blade 2 can also be braced to limit flexure during use. As seen in FIG. 1, a pair of lateral brace members 26 function as struts to limit bending of the blade 2 when loaded. The braces 26 can be secured at one end thereof to the pole segment 6D as with a threaded fastener and nut arrangement 27A, and at the other end to the blade 2 as with a threaded fastener and nut arrangement 27B.

Figure 3:
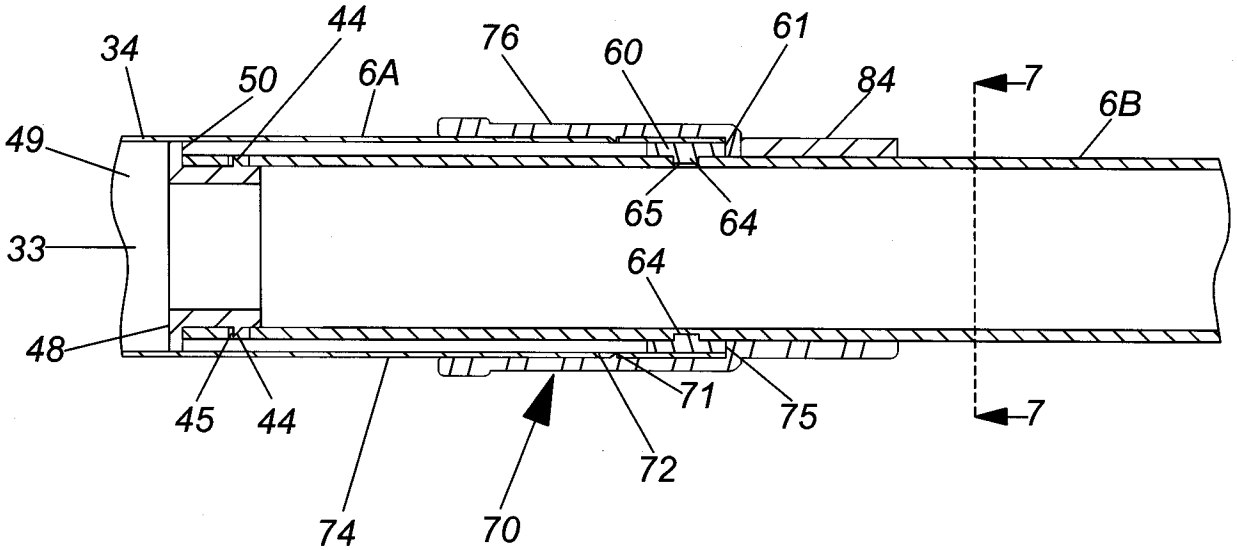
FIG. 3 is an enlarged fragmentary cross sectioned side view of two pole segments and a lock device.

The telescoping pole 3 has a plurality of segments 6 (denoted as 6A, 6B, 6C and 6D for distinction) associated with one another in a manner permitting selective relative longitudinal movement. That is, one segment 6 is movably received within the interior of another segment 6. The segment 6A is preferably formed of a reinforced polymeric material such as with fiberglass filler and is in the form of a hollow tube. The distal end portion 29 (relative to the blade 2) can be provided with a handle 31 secured thereto and preferably closing the distal end portion 29. The handle 31 can be provided with an opening 32 or other means to facilitate hanging the rake 1 for storage. Preferably, the segment 6A has a through passage (FIG. 3) extending between its opposite ends 29, 30. The passage 33 is generally round in transverse cross section. The shape of the outer surface 34 is also generally round in transverse cross section. The interior pole segments 6B-D are also preferably similarly generally round in transverse cross section. The interior segments 6B-D are preferably of aluminum tubing and are each sized to fit within its outermost adjacent segment 6 and be axially slidable therein.

Figure 4:
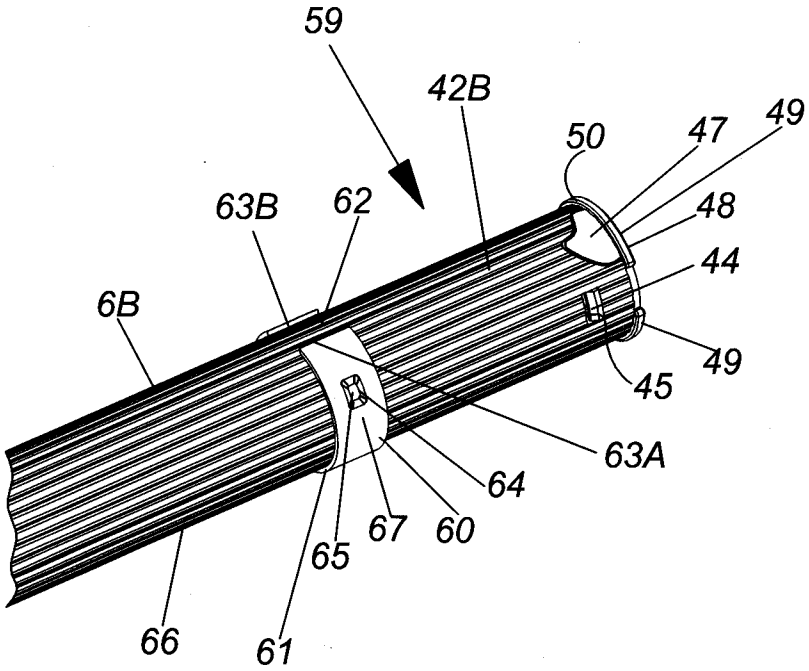
FIG. 4 is an enlarged fragmentary perspective view of an end portion of a pole segment illustrating components positioned inside that limit motion.
Figure 5:
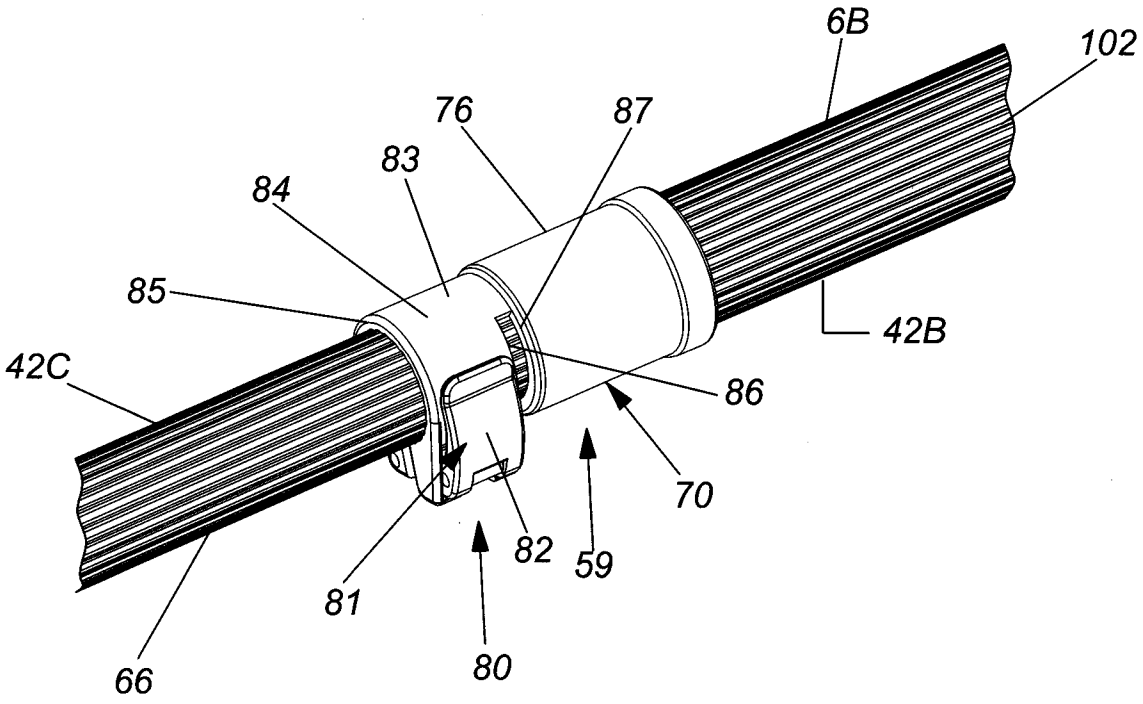
FIG. 5 is an enlarged fragmentary perspective view of a motion limiting means and two pole segments.
Figure 6:
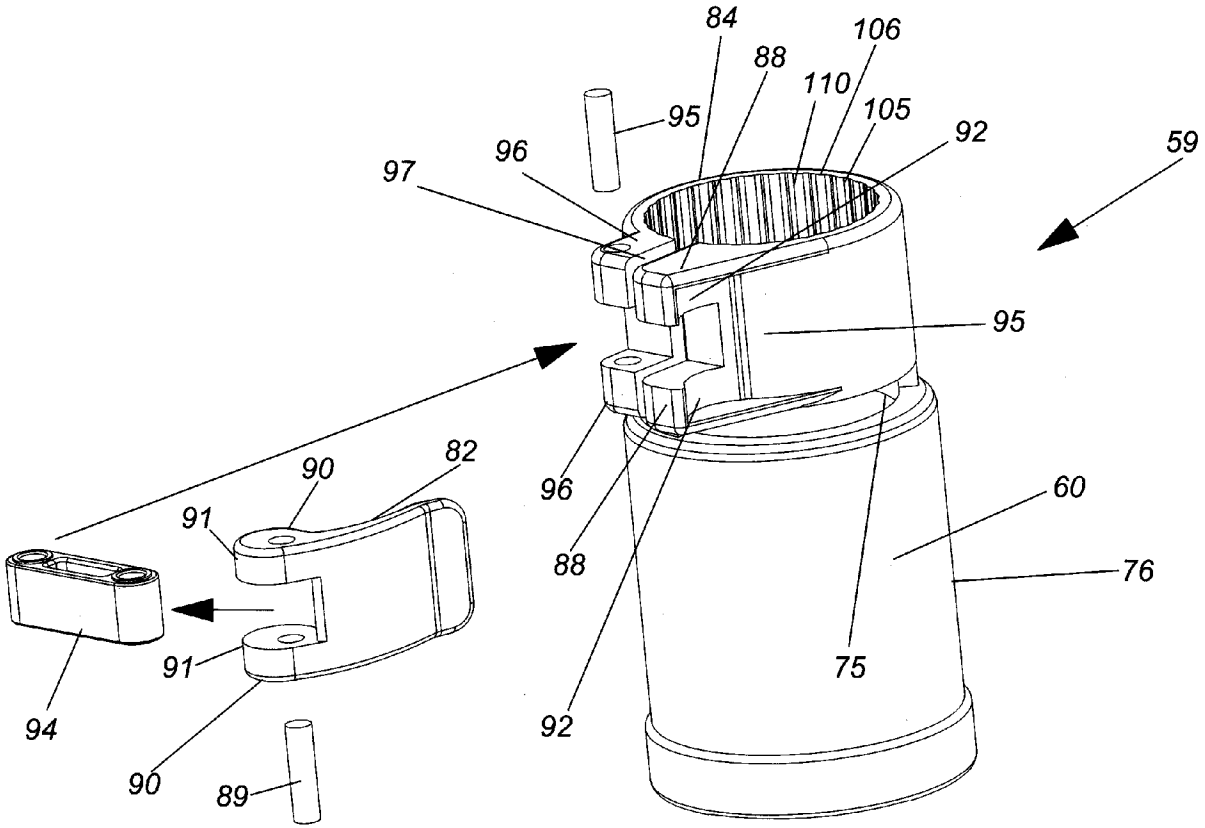
FIG. 6 is an enlarged exploded perspective view of a motion limiting means.
Figure 7:
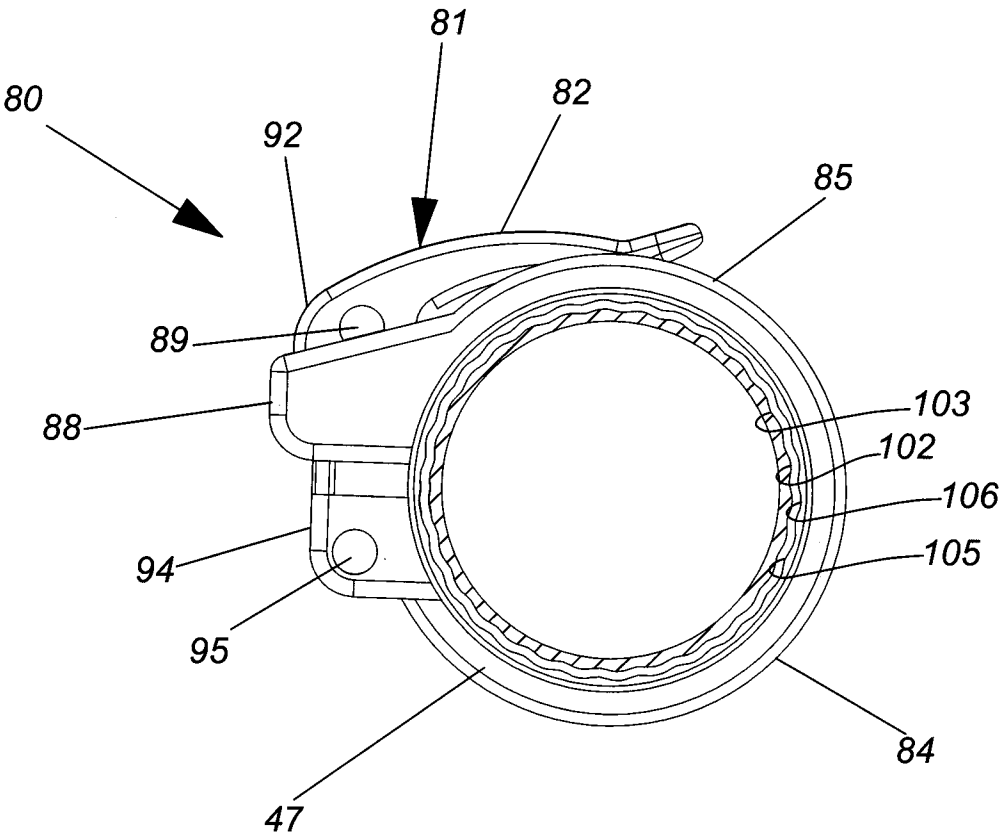
FIG. 7 is a cross sectional view of a lock device taken along line 7-7 in FIG. 3.

Means is provided for limiting relative axial movement between the pole segments 6A-D and relative rotation between the pole segments 6A-D. For relative axial movement, the means keeps the segments from separating and fixes the segments at a selected length of pole 3. For convenience, the details of pole 3 will be described using segments 6A and 6B, but it is to be understood that this description applies to the segments 6C and 6D as well. As seen in FIG. 4, the pole segment 6B has a slide bearing member 49 secured to an end portion 46 of pole segment 6B as with a snap lock detent 44 extending through an opening 45. As shown, the slide 49 includes a sleeve 47 mounted inside the respective end portion 46 of the pole segment 6B. The slide includes a radially extending flange 48 that projects radially beyond the exterior surface 42B of the segment 6B and is preferably sized to provide a bearing surface to engage an interior surface 43A, FIG. 3, of the adjacent outer segment 6A. The segments 6B-D each has an exterior surface, 42B-D respectively. The flange 48 has a proximally facing (toward the blade 2) surface 50.

The pole 3 also includes motion limiting means 59 to positively limit axial movement and separation of one pole segment 6 relative to an immediately adjacent pole segment 6; for example, pole segments 6A and 6B, which for convenience are used in the following description, as best seen in FIGS. 3-7. A stop member 60 is secured to the pole member 6B and has a circumferentially and radially outwardly extending shoulder 61 facing the blade or proximal end portion 24 of the pole 3. The stop member 60 is secured to the pole segment 6B to be immovable relative to the pole segment 6B. In the illustrated embodiment, the stop member 60 is in the form of a ring portion with a gap 62 between two ends 63A, 63B. The gap 62 allows for selective expansion and contraction of the diameter of the stop 60 for installation thereof on the pole segment 6B. The stop member 60 is fixed to the pole segment 6B against longitudinal movement therealong by having a protuberance 64 extend through an opening 65 in the sidewall 66 of the pole segment 6B. Engagement of an outer surface 67 of the stop member 60 with the interior surface 43A of the pole segment 6A retains the stop member secured to the pole segment 6B by limiting radial expansion of the stop member. Preferably, the stop member 60 is made by molding with a polymeric material such as so called self lubricating nylon. This construction also provides a slide bearing arrangement between the pole segments 6A, 6B.

The means 59 also includes a stop member 70 secured to the pole segment 6A. Preferably, the securement of the stop member 70 to a respective pole segment 6 is effective to require at least about 80 pounds of axially directed force to separate it from the respective pole segment 6. The stop member 70 includes an interior shoulder 75 facing the shoulder 61 and is operable to selectively engage with the shoulder 61 and positively stop extension and separation of the pole segments 6A, B to retain them in telescoping relationship. As shown, the stop member 70 has a sleeve portion 76 received over and engaging the proximal end 30 of the pole segment 6A. The stop member 70 is secured to the pole segment 6A as with a detent 71 extending through an opening 72 through the sidewall 74 of the pole segment 6A forming a snap lock arrangement to positively secure the stop member 70 to the pole segment 6A. This configuration prevents both axial separation of and relative rotation between the means 59 and its respective pole segment. The interior surface 43A can serve as a bearing surface for movement of the inner positioned pole segment 6B within the pole segment 6A riding on the surface 67 of the stop member 60 and also on the outer surface of the flange 48.

The means 59 also includes locking means, designated generally as 80, that is operable to fix adjacent pole segments at a selected extended or retracted position. In a preferred embodiment, the means 80 can also be configured to key adjacent pole segments 6 to one another to prevent relative rotation therebetween. As best seen in FIGS. 3-7, the means 80 includes a clamp mechanism 81 operable to selectively provide both a circumferential force and an inwardly directed radial force on the inner positioned pole segment 6B. A friction locking device 83 extends from the stop member 60 and preferably has portions thereof as an integral part. The locking device 83 has a fixed segment 84 with an interior surface shaped and positioned to engage an exterior surface portion 42B of the immediately adjacent inwardly positioned pole segment 6B. For convenience sake, the structure of the locking device 83 will be described relative to pole segments 6A, 6B, but the description also applies to the means 80 associated with the other pole segments 6B-D. The locking device 83 also includes a tab 85 extending generally circumferentially from the fixed segment 84 and has an edge portion 86 adjacent to an end of the stop member 70 and separated by a gap 87 allowing it to move circumferentially without restraint by the stop member 70. This permits selective expansion and contraction of the circumference of portions of the locking device 83. A lever clamp member 82 is pivotally associated with ears 88 that are preferably integral with the tab 85. The lever 82 is pivotally connected to a link 94 as with a dowel pin 89 extending through holes through ears 90 of the lever 82 and the link 94 allowing the lever 82 to pivot relative to the ears 88. The lever 82 is provided with a pair of eccentric cam surfaces 91 on the ears 90 that are engageable with a pair of corresponding cam surfaces 92 on the ears 88. The link 94 is also pivotally mounted adjacent one end thereof on a pin 95 to a pair of ears 96 that are positioned on and preferably integral with the fixed segment 84. There is a gap between the ears 88, 96 allowing the sets of ears to move relative to one another to allow the gap 97 to expand and contract. Pivoting movement of the lever 86 effects movement of the pivot pins 89, 95 selectively toward and away from one another via action of the cam surfaces 91 on the cam surfaces 92 to open and close the gap and effect selective clamping action of the fixed segment 84 and tab 85 with the pole section 6B to increase and decrease clamping force thereon and thereby fix the pole segments 6A, 6B at a desired extended or retracted position.

The clamping force, when applied via the lever 82, effects resistance to relative axial movement between the pole segments 6A, 6B. In a preferred embodiment, when clamped in position, the clamping force and resulting friction are sufficient to provide a resistance of less than the pole segment separation force discussed above and preferably at least about 50 pounds of axial pulling force to effect relative longitudinal movement between the pole segments 6A, 6B.

The pole segments 6 are keyed together to positively resist relative rotation between adjacent sections 6 at least when they are locked against relative axial movement. This allows for potential better control of the blade 2 during use to move snow or the like. In the illustrated structure, longitudinally extending ribs and grooves are provided and form a spline connection between adjacent pole segments. This will be described using again pole segments 6A and 6B as an example, but the description applies to the other pole segments 6. The exterior surface 42B of pole segment 6B is provided with a plurality of generally longitudinally extending alternating ribs 102 and grooves 103 (FIGS. 4, 7) that are in generally parallel relationship. As shown, they each have a generally U shaped transverse cross sectional shape and are generally similar in size and shape forming a so called star drive connection. Other shapes of the ribs and grooves may be used if desired. The ribs 102 and grooves 103 may be formed when the pole segment 6B is formed as by extrusion using a metal alloy such as aluminum alloy, and as shown extend along at least substantially the entire length of the pole segment. The locking means 80, and as shown, the clamp mechanism 81 is also provided with corresponding ribs 105 and grooves 106 for receiving and interengaging the grooves 103 and ribs 102 respectively in a manner that allows relative longitudinal movement of the pole segments 6A, B6, and when the clamp mechanism 81 is in an unlatched position will positively prevent relative rotation of the pole segments 6A, 6B when in a latched condition. As shown, the ribs 105 and grooves 106 are in the interior surface 110 of preferably both of the fixed segment 84 and tab 85 of the clamp mechanism 81.

In use, a rake 1 can be shipped with the blade 2 not assembled to the pole 3. After assembly, the user can easily adjust the length of pole 3 and lock the segments 6 at the desired length using the locking means 80 as described above. The blade 2 can then be positioned on a surface such as a snow covered roof, and with a pulling motion move the blade and material to be moved toward the user.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A snow rake with telescoping pole configured for pulling snow from a surface, the rake comprising:

a blade having a first surface portion for normally engaging material to be moved with a pulling force;

a pole having a plurality of tubular segments including a first segment and a second segment, said first and second segments being selectively movable axially relative to one another, said first segment being attached to said blade adjacent a proximal end portion of said pole and projecting from said blade generally away from the first surface portion with a distal end portion of said pole being remote from said blade, at least one said segment being a first segment and having an exterior surface portion received inside an interior bore surface of a second segment having an open end, said first and second segments being keyed with a rib and groove arrangement to resist relative rotation between said first and second segments;

a slide bearing member secured within an inner bore of said first segment, said slide bearing member including a radially extending flange that projects radially beyond said exterior surface of said first segment and is sized to engage said interior bore surface of said second segment;

a first stop member in the form of a sleeve surrounding an end portion of said first segment having an outer bearing surface sized to engage said interior bore surface of said second segment and a circumferential outwardly extending first shoulder, said slide bearing and said first stop member cooperating to provide a gap between said exterior surface of said first segment and said interior bore surface of said second segment;

a second stop member secured to an end portion of said second segment, said second stop portion having an inwardly extending second shoulder for engaging said first shoulder of said first stop member to prevent axial separation of said first and second segments; and a lock device mounted to said second segment adjacent said open end of said second segment receiving said first segment therein and operable to selectively lock said first and said second segments against relative axial movement at any of a plurality of axial positions between said first and said second segments.

2. The snow rake of claim 1 wherein the lock device including a fixed segment extending from the sleeve member and a tab extending from the fixed segment, said tab having a gap between a portion thereof and the sleeve member.

3. The snow rake of claim 2 wherein said lock device including a lever pivotally mounted to the fixed segment, one of the fixed segments and the tab having at least one first cam surface and the lever having at least one second cam surface whereby pivoting movement of lever urges relative movement between the first and second cam surfaces and urges the fixed segment and the tab into frictional engagement with the first segment to selectively fix the axial position of the first segment to the second segment.

4. A telescoping pole having a plurality of selectively relatively movable segments, the pole comprising:

a pole having a plurality of pole segments including a first segment and a second segment, said first and said second segments being selectively movable axially relative to one another, said first segment having an exterior surface portion received inside an interior surface of said second segment having an open end, said first and second segments being keyed with a rib and groove arrangement to resist relative rotation between said first and said second segments;

a slide bearing member secured within an inner bore of said first segment, said slide bearing member including a radially extending flange that projects radially beyond an exterior surface of said first segment and is sized to engage an interior surface of said second segment;

a first stop member in the form of a sleeve surrounding an end portion of said first segment having an outer bearing surface sized to engage said interior surface of said second segment and a circumferential outwardly extending first shoulder, said slide bearing and said first stop member cooperating to provide a gap between said exterior surface of said first segment and said interior surface of said second segment;

a second stop member secured to an end portion of said second segment, said second stop portion having an inwardly extending second shoulder for engaging said first shoulder of said first stop member to prevent axial separation of said first and second segments; and a lock device mounted to the second segment adjacent an open end of the second segment receiving the first segment therein and operable to selectively lock the first and second segments against relative axial movement at any of a plurality of axial positions between the first and second segments.

5. The pole of claim 4 including an implement mounted thereto adjacent an end of the pole.

6. The pole of claim 5 wherein the implement including a snow blade having a first surface portion for normally engaging material to be moved with a pulling force, said first segment being attached to the blade adjacent a proximal end portion of the pole and projecting from the blade generally away from the first surface portion with a distal end portion of the pole being remote from the blade.

* * * * *